United States Patent [19]
Baatz et al.
[11] 4,229,316
[45] Oct. 21, 1980

[54] DEVICE FOR THE STORAGE OR DISPOSAL OF RADIOACTIVE WASTES

[75] Inventors: Henning Baatz, Essen; Dieter Rittscher, Heiligenhaus, both of Fed. Rep. of Germany

[73] Assignee: Steag Kernenergie GmbH, Essen, Fed. Rep. of Germany

[21] Appl. No.: 875,079

[22] Filed: Feb. 3, 1978

[51] Int. Cl.[2] ..... G21F 5/00
[52] U.S. Cl. ..... 252/301.1 W; 250/506; 250/507
[58] Field of Search ..... 252/301.1 W, 301.15; 250/506, 507; 422/159

[56] References Cited

U.S. PATENT DOCUMENTS

| | | | |
|---|---|---|---|
| 3,365,578 | 1/1968 | Grover et al. | 252/301.1 W |
| 3,749,917 | 7/1973 | Kucherer | 250/506 |
| 3,845,315 | 10/1974 | Blum | 250/506 |

FOREIGN PATENT DOCUMENTS

| | | | |
|---|---|---|---|
| 2338480 | 2/1975 | Fed. Rep. of Germany | 250/506 |

*Primary Examiner*—Benjamin R. Padgett
*Assistant Examiner*—Deborah L. Kyle
*Attorney, Agent, or Firm*—Karl F. Ross

[57] ABSTRACT

A container for the ultimate disposal of radioactive wastes comprises an outer receptacle of standard size and interchangeable inner receptacles receivable in the outer receptacle and provided with spacers for centering the inner receptacle within the outer receptacle. For radioactive waste with reduced radioactivity, a larger receptacle containing a larger quantity of the waste can be disposed within the outer receptacle whereas, for more highly radioactive waste, a smaller receptacle containing smaller quantities of the radioactive waste can be disposed within the outer receptacle. The space between the two receptacles is filled with a substance capable of absorbing radiation from the inner receptacle, i.e. a radiation absorber or shielding material.

10 Claims, 6 Drawing Figures

DEVICE FOR THE STORAGE OR DISPOSAL OF RADIOACTIVE WASTES

FIELD OF THE INVENTION

The present invention relates to a device for the ultimate disposal of radioactive waste and, more particularly, for radioactive nuclear power plant wastes.

BACKGROUND OF THE INVENTION

In the disposal of radioactive wastes and particularly the disposal of radioactive nuclear power plant wastes or wastes derived from reprocessing plants for nuclear fuels and the like, it is conventional practice to provide standardized containers or receptacles having a predetermined shielding characteristic, in the interior of which the radioactive wastes are stored and which can be deposited for ultimate disposal of such wastes.

Because of industrial or government standardization, the customary practice is to provide standardized containers, i.e. containers with predetermined degrees of radioactive shielding, for the various types of wastes which may be produced or may have to be disposed of.

Naturally, such standardized containers cannot be used for radioactive wastes of different potency, i.e. a different degree of radioactivity. Thus, when radioactive wastes are generated which have greater or lesser radioactivity, it is necessary to provide standardized containers for these particular materials. For instance, when more highly radioactive wastes are to be disposed of, one normally uses a standardized container having a greater degree of shielding, i.e. a thicker shielding layer. Conversely, when radioactive wastes of reduced radioactivity are to be considered, a lesser degree of shielding may be required.

As a consequence, industrial or government standardization has resulted in the requirement that the installation generating such radioactive wastes must keep on hand a number of different standardized containers having different degrees of shielding for optimum disposal of radioactive wastes of different radiation intensities. This, of course, poses the problem for a nuclear power plant or an installation for reprocessing nuclear fuels since a large number of containers of different dimensions and shielding capabilities must be provided.

OBJECTS OF THE INVENTION

It is a principal object of the present invention to provide a radioactive-waste disposal system which obviates these disadvantages.

Another object of the invention is to provide a device for the ultimate disposal of radioactive wastes which enables the shielding of radioactive materials of different radiation intensities in accordance with industrial or government standards without requiring a large number of relatively massive containers of different dimensions to be stored or provided.

SUMMARY OF THE INVENTION

These objects and others which will become apparent hereinafter are attained, in accordance with the present invention, in a system for the final disposal of radioactive wastes which comprises an outer receptacle of given dimensions and wall thickness, an assortment of inner receptacles of different capacity and sizes, depending upon the intensity of the radioactive waste to be disposed of, the inner receptacle being spacedly received interchangeably in the outer receptacle, and a body of shielding material filling the space between the receptacles.

For radioactive wastes of reduced intensity, the inner receptacle can be of larger volume and capacity or size so that the walls of this inner receptacle more closely approach the walls of the outer receptacle. On the other hand, for radioactive wastes of greater intensity, the inner receptacle will have a smaller capacity and size and thus be spaced, by the aforementioned spacer means, more distantly from the walls of the outer receptacle. As noted, the outer receptacle can be a given size for an assortment of inner receptacles.

Naturally, when a smaller inner receptacle is centered within the outer receptacle, the space between the two receptacles is filled with a greater thickness of the shielding material so that the package is capable of intercepting radioactivity of greater intensity.

According to a feature of the invention, the spacer means is provided directly upon the inner receptacle and the spacing element of the spacer means can have a greater length for the smaller inner receptacle and a reduced length for the larger inner receptacle, thereby ensuring a greater spacing between the walls of the receptacles when the radioactivity of greater intensity is involved.

The invention derives from the recognition that the standard normally applied to the disposal of radioactive wastes requires that a package afford a greater degree of shielding and hence a greater thickness of shielding materials for radioactive wastes of higher activity than for radioactive wastes of lower activity.

This greater shielding in the case of radioactive wastes of greater intensity is achieved by spacing the inner or auxiliary receptacle more distantly from the wall of the outer receptacle which can have a given thickness, the space between the two receptacles being filled with a greater thickness of the shielding material.

It is thus possible, for an outer receptacle of given dimensions, to accommodate radioactive wastes of a wide variety of radiation intensities simply by using the selected one of the assortment of interchangeable inner receptacles which is appropriate thereto. By using the smaller receptacle with the longer spaces for the radioactive wastes of greater intensity, it is possible to automatically increase the spacing between the walls of the two receptacles and hence increase the thickness of the shielding material interposed between the walls of the two receptacles.

The auxiliary or inner receptacle can have a releasable or removable cover or a cover which is fixed permanently to the remainder of the receptacle. Naturally, when a removable cover is provided upon the auxiliary receptacle or the inner receptacle is disposed within the outer receptacle without a cover, a greater thickness of the shielding material must be provided between the top of the radioactive material within the inner receptacle and the cover.

The outer receptacle may also be provided with a permanently attached or removable cover as desired.

According to a feature of the invention, the space between receptacles is also used to accommodate means for treating radioactive wastes within the inner receptacle. It is frequently desirable to subject the radioactive wastes to a heating treatment to evacuate moisture therefrom or to carry out a setting operation. To this end, there can be provided, in accordance with the feature of the invention, within the space between the receptacles, removable or permanently emplaced heating rods or tubes traversed by heating fluid which can raise the radioactive wastes to a degasification or vaporization temperature.

The heating means within the space can also be used to ensure thorough fusion of the filling material which is disposed between the receptacles, e.g. when the filling material is to be liquefied and later solidified in place.

The advantages of the system of the present invention include the ability to provide a single outer receptacle for radioactive wastes of a wide range of radioactivities while maintaining the necessary shielding standards.

A nuclear power plant or institute or other establishment for supplying nuclear fuels to nuclear power plants or for reprocessing the fuels of nuclear power plants, no longer must stock large numbers of massive receptacles of different standard radioactive shielding capacities. The introduction of radioactive wastes into the package of the present invention can be accomplished readily and by conventional processes.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
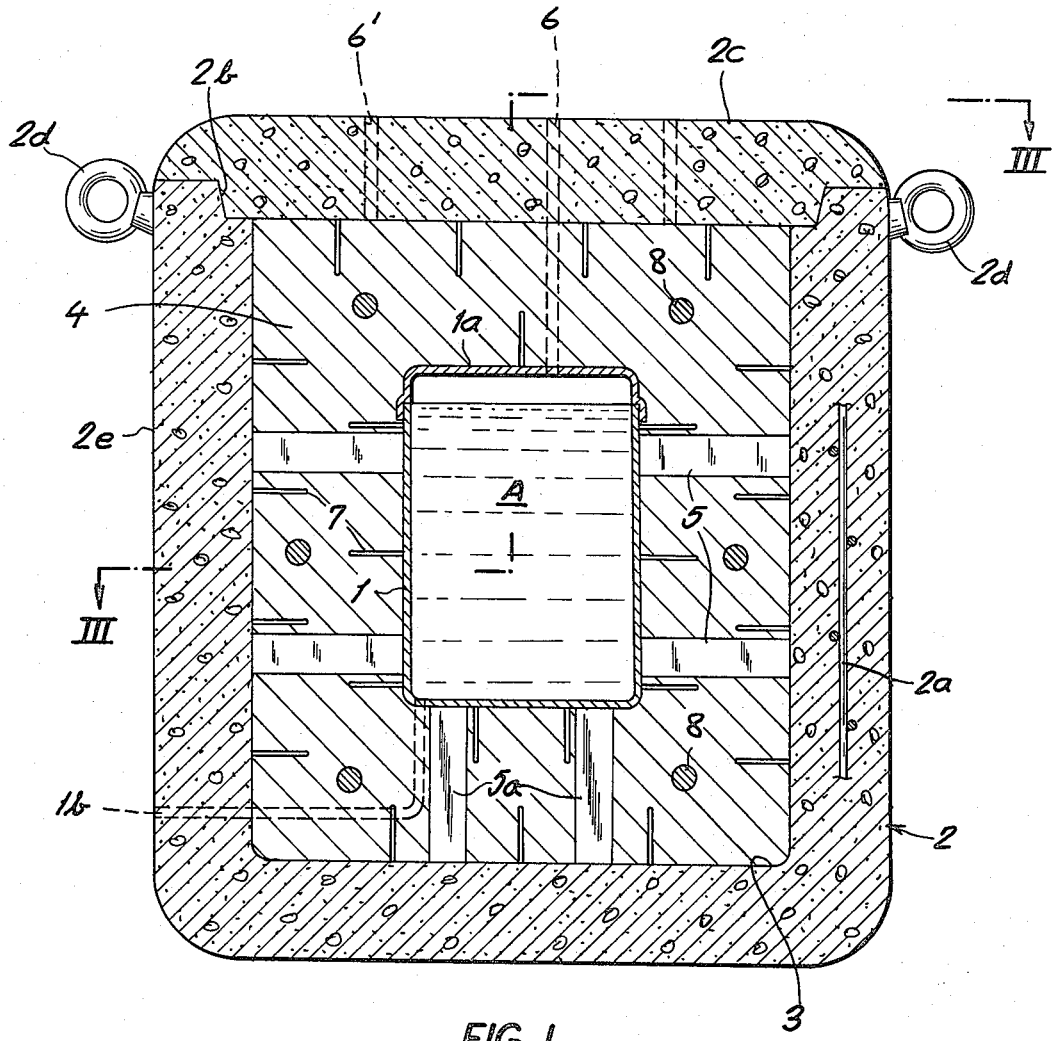
FIG. 1 is a vertical cross-sectional view through a package for the final disposal of radioactive wastes according to the invention.
Figure 2:
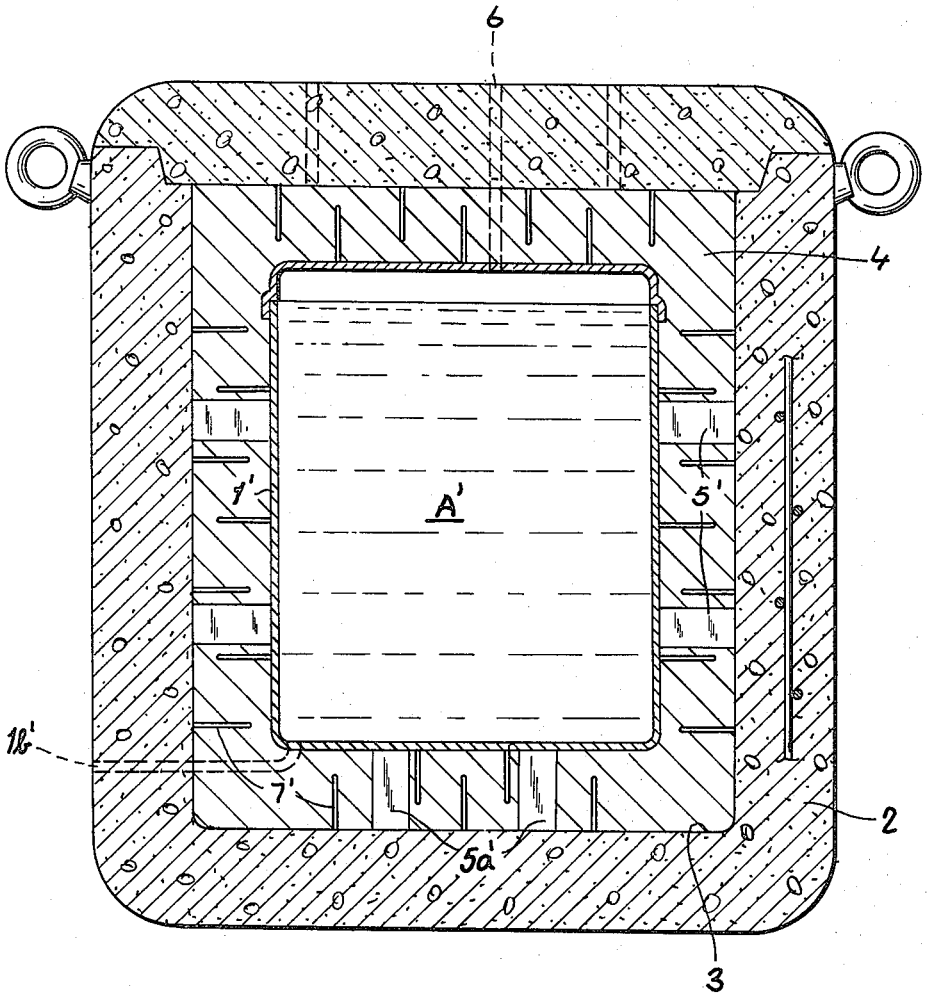
FIG. 2 is a similar view of a package for the disposal of radioactive wastes of lesser radiation intensity.
Figure 3:
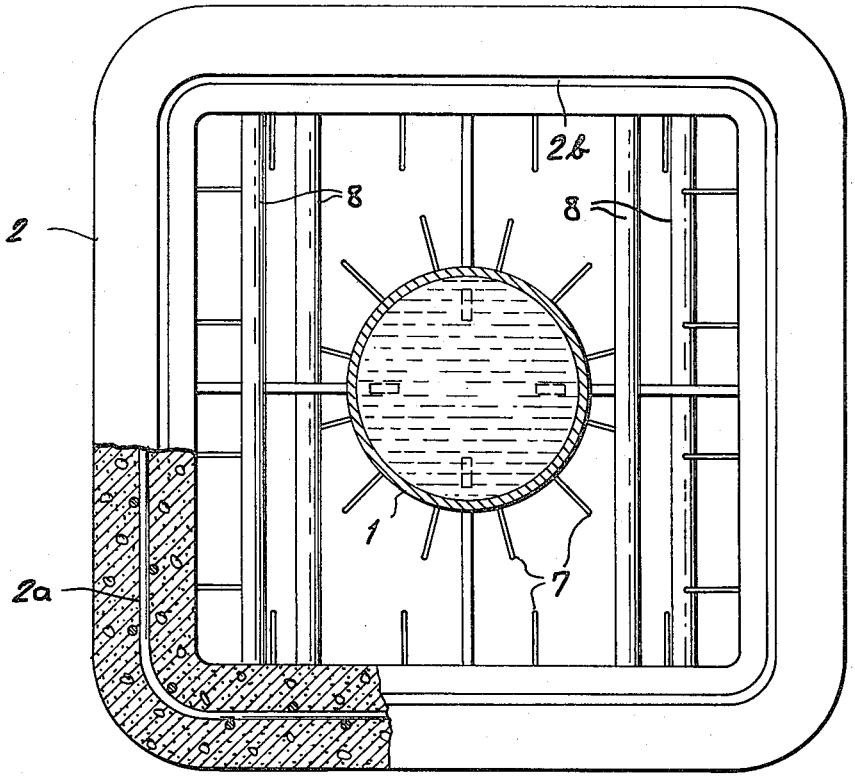
FIG. 3 is a cross-sectional view taken along the line III—III of FIG. 1, but showing the package with the shielding filling material omitted.

The device illustrated in FIGS. 1–3 of the drawing is provided for the disposal of radioactive wastes A, especially for radioactive nuclear power plant wastes.

The device essentially comprises an outer receptacle 2 having standardized dimensions and radioactive shielding capacity and preferably composed of a radioactive shielding material such as concrete which can be reinforced, e.g. via the reinforcing rods represented at 2*a*.

The outer receptacle 2 is formed with an upwardly open lower container 2*e* which can be formed with eyes 2*b* enabling the container and the entire package to be lifted by a crane.

The mouth of the container 2*e* is stepped as shown at 2*b* to be tightly fitted with a complementarily stepped cover 2*c* which can be permanently secured to the container 2*e* with an adhesive or by an additional layer of concrete.

The outer receptacle 2 is provided with an interior space 3 which receives the radioactive waste A in an inner receptacle 1 which can have a relatively thin wall which also has some shielding function. A cover 1*a* can be permanently affixed to or removable from the inner receptacle 1.

According to the invention, the inner receptacle 1 is provided with lateral spacing arms 5 and downwardly extending spacing arms 5*a* dimensioned to center the radioactive-waste enclosure within the chamber 3.

As can be seen by a comparison of FIGS. 1 and 2, a number of replaceable or interchangeable receptacles 1 and 1' can be provided and the arms 5, 5*a* or 5' 5*a'* can be correspondingly dimensioned to ensure an appropriate centering of whichever inner receptacle 1 or 1' is selected.

The space between the receptacles, i.e. the chamber 3 which is not occupied by the receptacle 1 or 1', is filled with a mass 4 of shielding material. This mass 4 can be constituted by molten lead or a pulverulent shielding material such as, for example, a lead-containing mineral. Other materials of high neutron cross-section, e.g. bitumen or paraffin can also be used, depending upon the radiation-shielding standard involved.

As is also apparent from FIGS. 1 and 2, a smaller receptacle 1 is employed when the radioactive substance A has a higher radiation intensity. A larger receptacle is used as shown at 1' when the radiation intensity of the radioactive waste A' is less. In the case of higher intensity, therefore, a greater thickness of the shielding material 4 is provided.

A tube 1*b* may open into the receptacle, a corresponding tube 1*b'* being provided in the case of the embodiment of FIG. 2, to fill the radioactive material into the inner receptacle. Alternatively, the tubes 1*b* and 1*b'* may be eliminated when the receptacle 1 or 1' is filled prior to its insertion into the outer receptacle 2.

As shown in FIG. 1, the space 3 may also be provided with heating rods 8 or other treating means for subjecting the radioactive wastes to evaporation or other thermal treatment. The heating rods may also be used, if desired, to melt the shielding material 4 and ensure a complete distribution of the shielding material 4 within the space 3 without air bubbles or the like. The heating rods 8 are lost within the body of the shielding 4 and become part of the package.

In the embodiment of FIGS. 1 and 2, the walls of the inner and outer receptacles are formed with rods 7 and 7' which project into the material 4 and serve to anchor the material 4 and the receptacle 1'.

The receptacle 1 and the receptacle 2 can be provided with passages 6 and 6' for venting the gases from the package during the filling or heating operations or to serve as filling passages. The tubes 1*b* and 1*b'* and the passages 6 and 6' are ultimately filled with radiation shielding material. More particularly, the passages 6 can serve for pumping material into the package or evacuating vapors therefrom. A material capable of encapsulating the radioactive wastes and hardening inside tube, e.g. liquid bitumen, can also be introduced through the passages 6 in which case the liquid bitumen can ultimately fill these passages.

Figure 4:
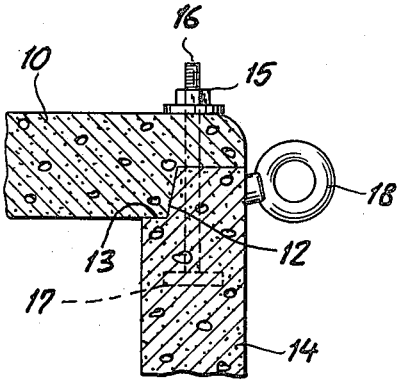
FIG. 4 is a detail view showing one mode of attachment of the cover of the outer receptacle to the remainder nearof.

As can be seen from FIG. 4, the cover 10 for the outer receptacle 14 can be complementarily stepped at 12 to fit tightly upon the mouth 13 of the outer receptacle 14. In this case eye 18 is affixed to the outer receptacle 14 while bolts 16 attached to plates 17 may be embedded in the concrete of the container 14 so that nuts 15 can be threaded onto the bolts 16 to secure the cover 10 in place.

Figure 6:
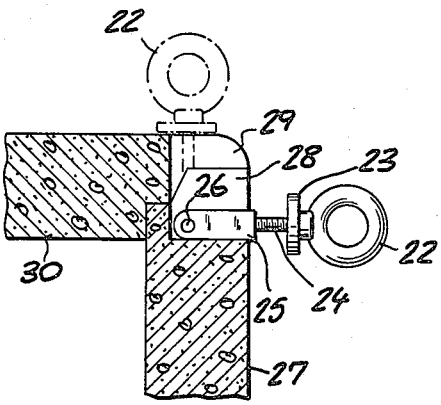
FIG. 6 is another detail view similar to FIG. 4 showing yet another embodiment of the invention.
Figure 5:
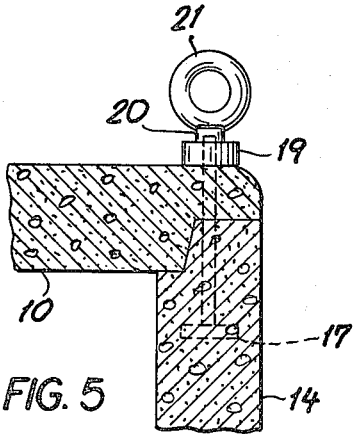
FIG. 5 is a detail view similar to FIG. 4 illustrating another embodiment of the invention.

An alternative construction has been shown in FIG. 5 in which the bolts 16 receive nuts 19 which are also formed with necks 20 to which the eyes 21 are secured. In this case, the cover-securing means is also provided with lifting eyes to enable the package to be moved by a crane. In the embodiment of FIG. 6, the eye 22 is formed as a nut 23 on a bolt 24 swingable on a lug 25 about a pen 26 anchored in the container 27 and within a slot 28 thereof. When the lug is swung in the counterclockwise sense into a slot 29 of the cover 30, the nut 23 may be tightened to clamp the cover in place.

In place of the heating rods 8, heating means such as tubes through which a heating fluid can be circulated, can be received in the chamber 3.

We claim:

1. A packaging system for the disposal of radioactive wastes of different radiation intensities, comprising:

an outer receptacle of a standard size uniform for all of said intensities and of a predetermined radiation absorbing capacity;

a plurality of inner receptacles of different volumes adapted to receive radioactive waste, a selected one of said inner receptacles being enclosed within said outer receptacle and having a volume determined by the intensity of the radiation emitted by the radioactive waste thereof with a smaller inner receptacle receiving waste of greater radiation intensity and a larger inner receptacle receiving waste of lesser radiation intensity;

spacer means for centering the selected inner receptacle within said outer receptacle so that the space between the outer receptacle and the selected inner receptacle is greater for the smaller receptacles than for the larger receptacles; and a radiation-shielding material disposed all around said inner receptacle in said space between the outer wall of said inner receptacle and the inner walls of said outer receptacle so that the thickness of the radiation-shielding materials around the selected inner receptacle is greater for the smaller inner receptacles with waste of greater radiation intensity than for the larger receptacles with waste of lesser radiation intensity.

2. The system defined in claim 1 wherein said spacer means includes spacer elements extending outwardly from the outer wall of each of said inner receptacles.

3. The system defined in claim 1, further comprising heating means in the space between said receptacles.

4. The system defined in claim 3 wherein said heating means are heating rods embedded in the shielding material.

5. The system defined in claim 1 wherein said outer receptacle is provided with a cover, further comprising means for securing said cover on said outer receptacle.

6. The system defined in claim 5 wherein said outer receptacle is composed of reinforced concrete.

7. The system defined in claim 6 wherein said inner receptacle has a cover.

8. The system defined in claim 7, further comprising at least one passage formed in said outer receptacle and communicating with said inner receptacle.

9. The system defined in claim 8 wherein said walls are provided with anchor elements embedded in said shielding material.

10. A method of packaging radioactive wastes of different radiation intensities, comprising the steps of:

(a) providing a plurality of standardized outer receptacles of a standard size uniform for the packaging of all of said intensities and having a wall thickness affording the outer receptacle a predetermined radiation-absorbing capacity;

(b) selecting among a plurality of inner receptacles of different volumes, an inner receptacle having a volume corresponding to the radiation intensity of a particular waste to be packaged so that, when said particular waste is received in the selected inner receptacle and the selected inner receptacle is introduced into said outer receptacle, the space between said selected inner receptacle and said outer receptacle will correspond to a thickness of radiation shielding-material sufficient, in combination with the thickness of the outer receptacle, to completely absorb radiation from said particular waste;

(c) introducing said particular waste into said selected inner receptacle;

(d) introducing said selected inner receptacle after said particular waste has been introduced therein, into said outer receptacle and spacing the inner receptacle in said outer receptacle from the latter by a distance corresponding to said thickness of radiation-shielding material; and (e) filling the space between the selected inner receptacle and the outer receptacle with said radiation-shielding material.

* * * * *